US006202579B1

(12) United States Patent
Olewicz et al.

(10) Patent No.: US 6,202,579 B1
(45) Date of Patent: Mar. 20, 2001

(54) AUTOMATED APPARATUS FOR MANUFACTURE OF MATTRESS BORDERS WITH SEWN HANDLES

(75) Inventors: Tadeusz Olewicz, Hoschton; Preston Dasher, Lawrenceville; Elvin Price, Dacula; John Chamlee, Lawrenceville; Michael Pate, Sugar Hill; George Price, Lawrenceville; Gonzalo Mora, Atlanta, all of GA (US)

(73) Assignee: Sealy Technology LLC, Trinity, NC (US)

( * ) Notice: Subject to any disclaimer, the term of this patent is extended or adjusted under 35 U.S.C. 154(b) by 0 days.

(21) Appl. No.: 09/479,447

(22) Filed: Jan. 11, 2000

(51) Int. Cl.[7] ..... D05B 11/00
(52) U.S. Cl. ..... 112/2.1; 112/470.34
(58) Field of Search ..... 112/2.1, 10, 113, 112/114, 147, 152, 470.09, 470.14, 470.16, 470.33, 475.06, 475.07, 475.08

(56) References Cited

U.S. PATENT DOCUMENTS 4,114,544 * 9/1978 Miyachi et al. ..... 112/470.34
4,137,857 * 2/1979 Miyachi et al. ..... 112/470.34
4,803,935 * 2/1989 Off ..... 112/470.34
5,588,384 * 12/1996 Miyachi et al. ..... 112/470.34 X
5,738,029 * 4/1998 Porter et al. ..... 112/2.1
5,881,656 * 3/1999 Grant ..... 112/2.1
5,983,814 * 11/1999 Block ..... 112/2.1

* cited by examiner

*Primary Examiner*—Ismael Izaguirre
(74) *Attorney, Agent, or Firm*—Arter & Hadden LLP

(57) ABSTRACT

A machine for automatically producing a mattress border with handles sewn to the border material. Border material is pre-fed from a selected spool, screened for splice avoidance and measured. Handle material is fed from a selected spool mounted in a multiple handle material spool magazine mounted on rails, fed into a handle folding assembly, and cut to length. Ends of the handle material are folded under by the handle folding assembly and the handle then transferred in a folded condition from the handle folding assembly to a correct position on the border material. A double frame handle press holds each folded end of the handle material in place as each end is maneuvered under a sewing head needle to apply a stitch pattern to secure the folded ends to the border material. The double frame handle press is translated separately from the carriage assembly which travels in the sew pattern, to position the other end of the handle under the sewing needle.

36 Claims, 6 Drawing Sheets

AUTOMATED APPARATUS FOR MANUFACTURE OF MATTRESS BORDERS WITH SEWN HANDLES

FIELD OF THE INVENTION

The invention pertains generally to automated sewing operations and, more particularly, to automated sewing operations which include folding and attachment of one piece of material to another.

BACKGROUND OF THE INVENTION

Mattresses have traditionally been provided with handles on the vertical side panel or "border" material which covers the side of the mattress, between the top and bottom surfaces. Such border handles are most commonly in the form of a rope or elastic cord, with the ends extending through grommets in the border material and knotted or stapled inside the mattress. The assembly of such handles is labor intensive, requiring measurement for grommet placement, operation of a grommet press, and insertion and securement of each end of the handle through the grommet.

More recently, handles made of a strip of fabric have been sewn to the border material. This requires that each end of the handle is secured by a substantial stitch pattern, such as a box with an X stitch pattern inside the box, in order to give the attachment sufficient strength. To sew a multi-dimensional pattern requires that the mattress border, with the handle in place on top of it, be moved in different directions on a platform under the sewing needle. Also, the ends of the handle can be folded under to double the thickness of material and further increase the strength of the handle. This can be done by hand, or by clamping the handle (with the ends folded) against the border and moving the clamped pieces by an automated carriage assembly, by use of an "X-Y" sewing machine. For example, the Mitsubishi PLK series sewing machines are equipped with an X-Y translation carriage mechanism, to which a clamping assembly can be attached, as described in U.S. Pat. Nos. 5,520,129 and 5,738,029. The '029 patent describes certain modifications to the stock Mitsubishi carriage assembly to increase the X-direction range of motion of the entire assembly, to position an opposite end of a mattress handle under the sewing head. This requires a large amount of repeated mechanical motion for high speed continuous production. Also, the '029 patent requires that each handle be folded and inserted into a clamp by hand, and that the border material be advanced by hand to position it for attachment of the next handle.

Other machines have been developed which automatically fold material prior to placing it in position on another piece of material for sewing. This is common, for example, in the automated attachment of belt loops, such as described in U.S. Pat. Nos. 3,699,907; 4,385,571 and 4,393,800. Although such machines are functional, they do not represent the most efficient and flexible means of mass producing sewn articles, or to produce a specific component in its entirety such as a mattress border.

SUMMARY OF THE INVENTION

The present invention overcomes these and other disadvantages of the prior art, by providing an automated machine for producing measured and cut mattress borders with end folded handles attached by sewing. In accordance with one aspect of the invention, there is provided a machine for automatically producing a mattress border with at least one handle sewn to the mattress border material. The machine includes a spool of border material; a border material feed mechanism for feeding border material from the spool of border material; a spool of handle material; a handle material feed mechanism operative to feed and cut handle material from the spool of handle material; a handle cutter for cutting a handle from the handle material; a sewing platform over which the border material passes; a handle folder assembly for folding ends of a handle under prior to placement of a folded handle on the border material at a position where the folded handle is to be sewn to the border material, the handle folder assembly having: a folding plate having first and second ends; a folding blade at each end of the folding plate, each folding blade operative to descend down upon an end of a handle which extends beyond an end of the folding plate, and further operative to move underneath an end of the folding plate to fold the end of the handle under the folding plate; a clamp fork positioned over each end of the folding blade and operative to be lowered upon a folded end of the handle, and operative to move the handle off of the folding blade and on to the border material; a double frame handle press operative to frame and compress each folded end of the handle material positioned on the border material, and to move each folded end of the handle upon the sewing platform and under a sewing needle in a sewing pattern which attaches the folded ends of the handle to the border material.

In accordance with another aspect of the invention, there is provided a machine for automatically sewing ends of a fabric handle to a mattress border, the machine having: a supply of border material; a supply of handle material; a handle folding assembly; a double frame handle press; a sewing platform, and a sewing head; drive rollers for drawing border material from the border material supply onto the sewing platform; drive rollers for drawing handle material from the handle material supply into the handle folding assembly; a handle material cutter for cutting a length of handle material from the handle material supply; the handle folding assembly having: a folding plate with first and second ends about which ends of a piece of handle material are folded; folding blades which are actuated to descend down upon the ends of the handle material and under the folding blade; folded handle transfer arms which transfer the handle material with the ends folded from the folding blade on to the border material on the sewing platform; and a double frame handle press which compresses down upon the handle on the border material.

And in accordance with still another aspect of the invention, there is provided a material folding device operative to fold a portion of a piece of material under a plate and to transfer material in a folded condition, the device having: a folding plate having a planar surface for supporting at least a portion of material to be folded, and ends beyond which a piece of material may extend; at least one material holding device above the folding plate, the material holding device being controllable to extend downward into contact with a piece of material on the folding plate, and at least one folding blade operative to extend downward past an end of the folding plate and to extend under an end of the folding plate.

These and other novel aspects of the invention are described with specific reference to the accompanying Figures.

DETAILED DESCRIPTION OF THE INVENTION

Figure 1:
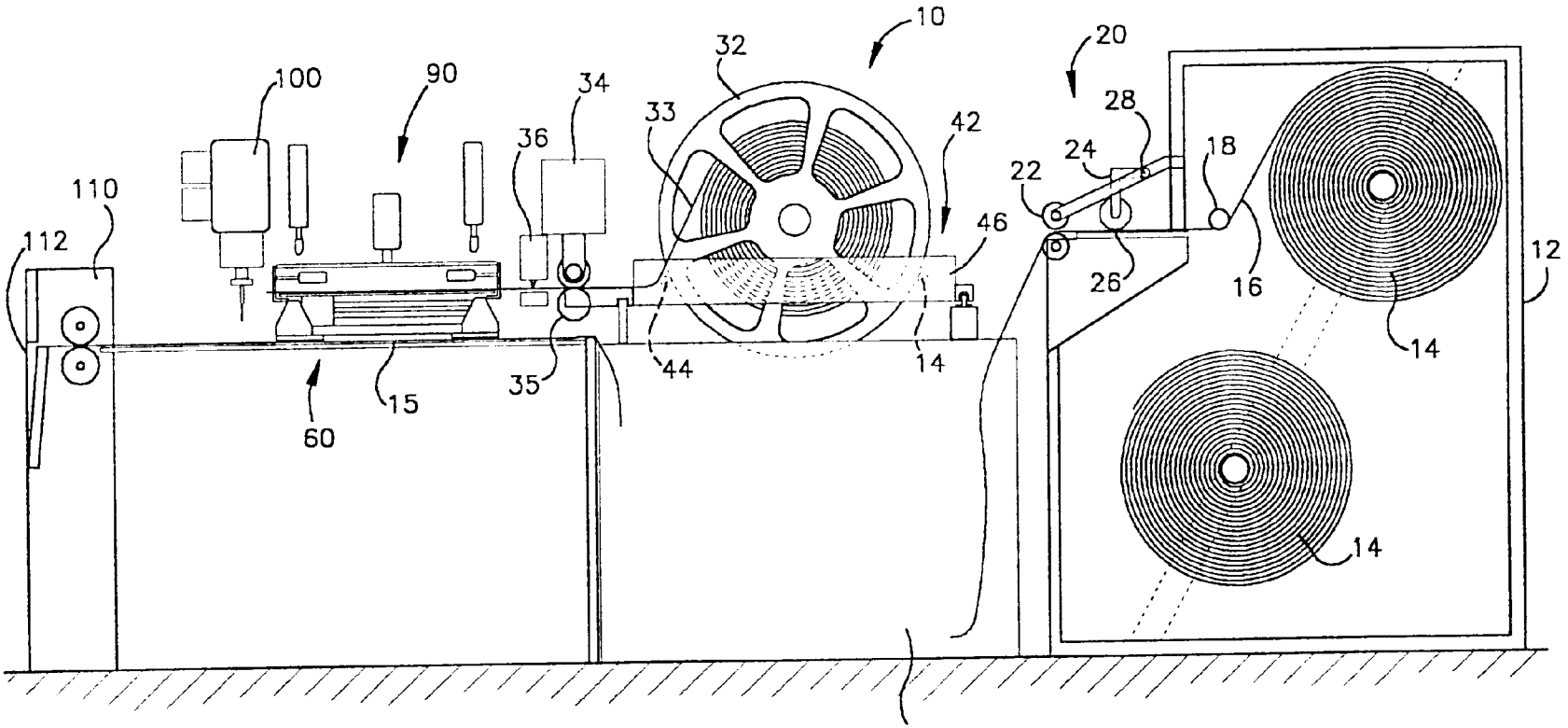
FIG. 1 is a schematic side elevation of an automated mattress border production machine constructed in accordance with the present invention.

An exemplary description of the invention follows, where it is understood that like reference numerals refer to like elements. FIG. 1 shows schematically at 10 an automated apparatus for producing mattress borders with folded and sewn handles. The apparatus 10 automatically performs the primary functions of:

1) measuring a length of border material sufficient for the size mattress to be made;
2) feeding and cutting material from a selected handle material spool to form a handle;
3) folding the ends of the handle material under and placing and holding the handle material in a folded condition at a proper location on the border material;
4) sewing the folded ends of the handle material to the border material;
5) advancing the border material to repeat the process for attachment of all handles, and
6) cutting the border material to a proper length to form a mattress border.

As depicted in FIG. 1, the process moves generally from right to left. A border material spool rack 12 is used to support one or more spools 14 of border material, which as known in the industry is typically quilted material or "ticking" of upholstery grade with a fill or foam and a backing layer. The rack 12 configured with multiple spools 14 provides a flexible border manufacturing system whereby borders of differing colors and styles can be produced without reloading or stocking the machine. The rack 12 is designed to rotatably mount multiple spools 14 in general alignment with a sewing lane of the machine, i.e., along a central axis about which the operative components are aligned. The spools 14 may be threaded into the apparatus 10 from a stationary position, or the spools 14 may be indexably mounted on the rack 12 to slide in and out of a feed position. Alternatively, the spools 14 can be mounted on a vertically mounted carousel which can be indexed to the selected spool.

From the spool 14, border material 16 is threaded under a turning or pin 18 into a border material pre-feeder indicated generally at 20, which includes a pair of pre-feed drive rollers 22 for advancing the border material from the spool. An encoder 24 is used to measure the length of the advanced material. The encoder 24 includes a wheel 26 that measures border material linear length by counting the turns of the wheel 26 times its known circumference. This information is communicated to a control system which controls the drive rollers 22 to automatically roll out a pre-selected border length. The encoder 24 is mounted on a hinge 28. In this way, a seam or splice in the material registers as a "bump" and displaces the encoder 24 about the hinge 28, which is indicated to the control system. When a splice or any flaw in the border material is detected in this manner, the control system directs the drive rollers 22 to advance the material to bypass the splice or flaw and cut it out of the border, so that a border section of the correct length can be measured that does not include a splice or flaw. The pre-measured border material is deposited into a holding bin 30. Alternatively, detection of border material length insufficient to make a complete border can direct the machine to produce two border halves, which can thereafter be assembled into a single border.

Handle material 33 is retained on a separate spool 32, generally aligned with the border material spool and the sewing lane of the apparatus 10. A handle material feed assembly, indicated generally at 34, includes a pair of driver rollers 35, which are controlled by the control system to measure off and advance a predetermined length of handle material. A handle cutter 36, such as a guillotine-type knife, is provided to cut the material 33 to length to produce a handle blank 40, which is attached by stitching to the border material, as further explained herein.

Figure 9:
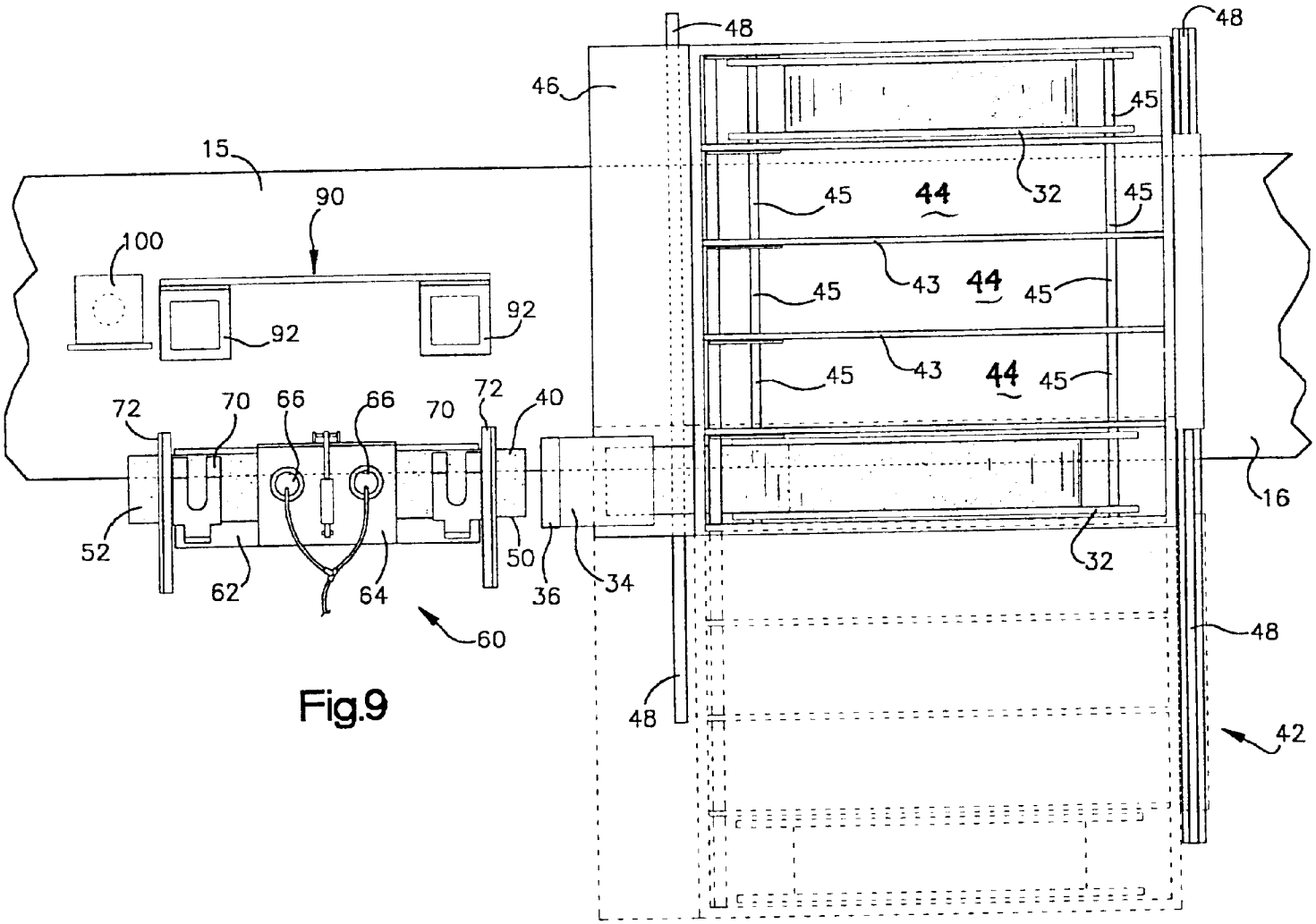
FIG. 9 is a plan view of the handle material magazine, handle folding assembly and double frame handle press of the apparatus of the invention.

As best shown in FIG. 9, in a preferred embodiment one or more handle material spools 32 are supported in a magazine 42 configured with walls 43 on a frame 46 which form multiple channels 44 to support a plurality of spools 32 in a parallel arrangement. Each spool 32 is supported to rotate within a channel 44 on a pair of knurled rollers 45 journalled to rotate between walls 43. The frame 46 is mounted to roll upon transverse rails 48, with a locking pin indexable in holes to fixedly align a selected spool with the handle material feed assembly 34. By this arrangement, multiple handle material spools can be stocked in the machine, and an operator can quickly select, position and feed material from a spool for production of borders to varying specifications.

As further shown in the Figures, the apparatus includes a handle material folding assembly, indicated generally at 60, which functions to fold the ends of the handle blank 40 and position it upon the border material for attachment by sewing. The handle blank 40 having two ends 50, 52 is discharged from the feed assembly into the folding assembly 60. In certain embodiments, a support arm or handle blank feeder may extend from the handle material feed assembly 34, under the handle blank 40, in order to facilitate transfer of the handle blank 40 from the feed assembly 34 to the folding assembly 60. The folding assembly 60 includes a generally rectangular folding plate 62 about which handle ends 50, 52 are folded. The folding plate 62 is covered by a top plate 64 which aligns and retains the handle blank 40 during folding. Mounted on the top plate 64 are one or more material holding devices 66, such as inflatable diaphragms, operative to extend downward from the top plate 64 to contact the underlying material blank 40 to stabilize it prior to and during the automated folding operation. In a preferred embodiment, the diaphragms 66 are pneumatically actuated rubber bladders, of the type manufactured by Festo Co., but any other type of actuation could be employed (e.g. hydraulic, electromagnetic, etc.) to extend an object downward into contact with the handle blank, any of which are within this conceptual aspect of the invention. In commercial form, a metal disk is attached to the extended end of the bladder. However, in the present invention it has been found that use of the bladders without the metal disk is advantageous for the positive gripping contact the rubber makes with the handle material.

Figure 2:
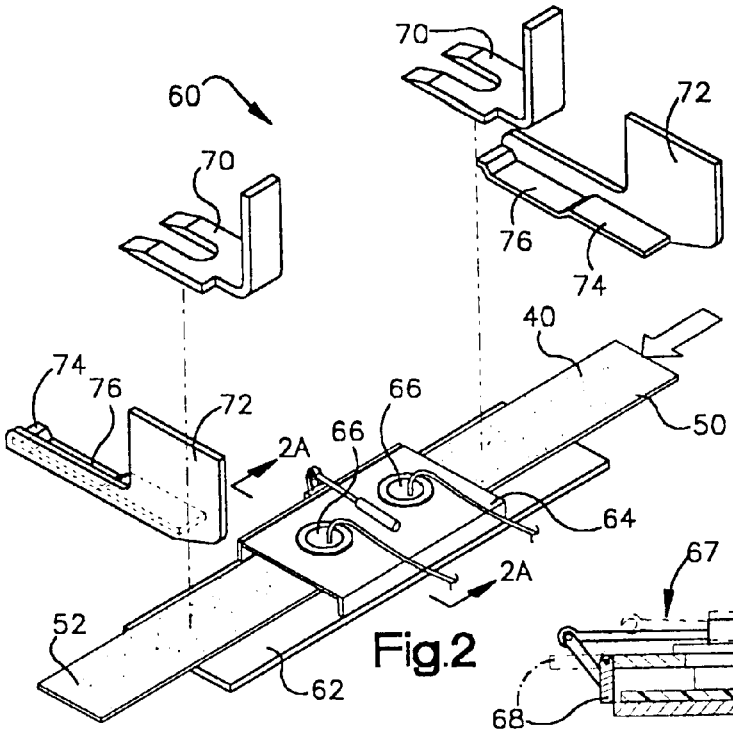
FIGS. 2 and 2A are perspective and end views, respectively, of certain components of a handle folding assembly of the invention.
Figure 2A:
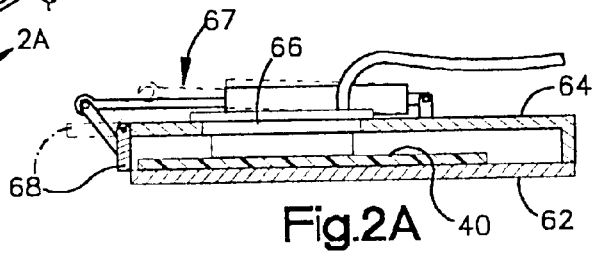
Figure 3:
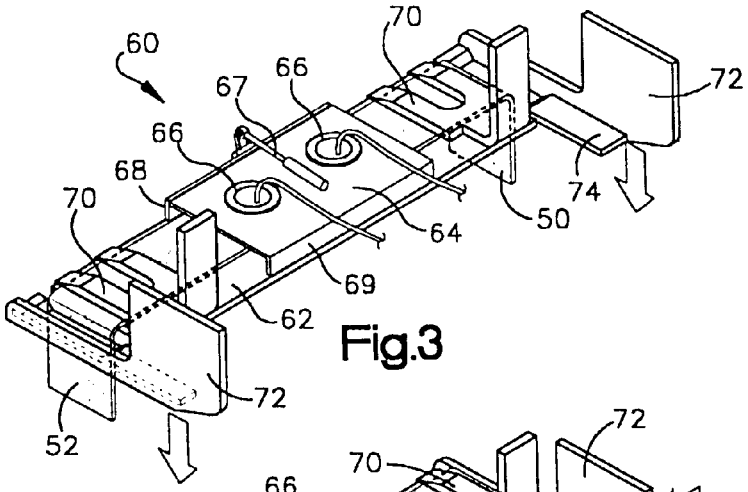
FIGS. 3 and 4 are each perspective views of certain components of a handle folding assembly of the invention.
Figure 4:
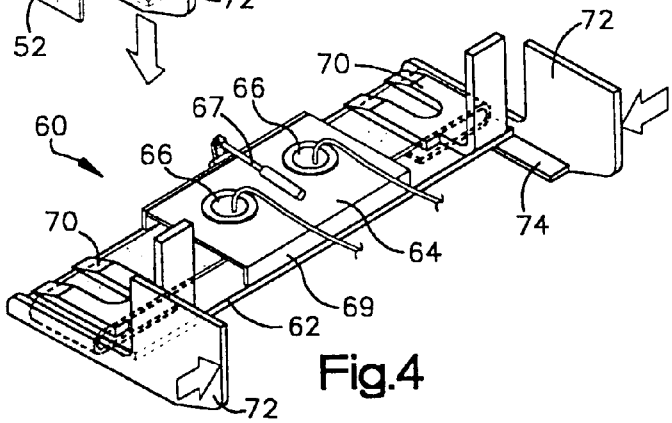

As is best shown in FIG. 2, the folding assembly 60 includes a pair of fork members 70 (also referred to herein as "fold compression devices") which are operatively mounted upon a translation mechanism to vertically descend down upon the handle blank 40 against the folding plate 62 after the blank 40 has been positioned with ends 50 and 52 extending off of the respective ends of the folding plate 62. Although shown in the form of forks, the fold compression devices 70 could be of an alternate configuration suitable to apply pressure to the folded portion of the handle material. After the fork members 70 are in place, folding blades 72, also operatively mounted upon a translation mechanism, vertically descend to downwardly displace the handle ends 50, 52, as shown if FIG. 3. As shown in FIG. 4, the blades 72 are next controlled to converge laterally under opposite ends of the folding plate 62, wrapping the handle ends 50, 52 under the ends of the folding plate 62. The blades 72, each include a lower lip 74 which faces inwardly and slides under the folding plate 62 in order to facilitate the folding of the ends 50, 52. The lower lip 74 further includes a recess 76 for retaining and registering the folded ends in alignment, particularly during removal of the folded handle blank from the folding plate 62, as further described.

Figure 5:
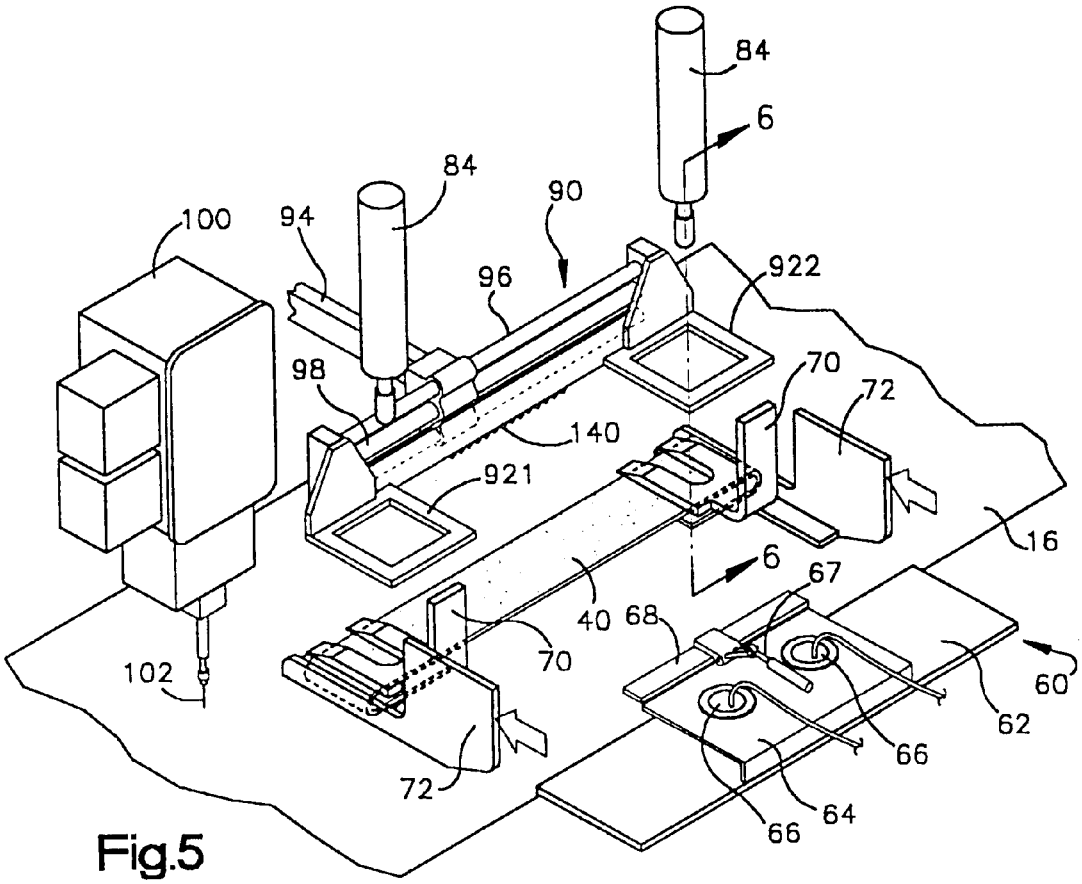
FIGS. 5, 7 and 8 are perspective views of certain components of the handle folding assembly, double frame handle press, sewing head and sewing platform of the apparatus of the present invention.
Figure 6:
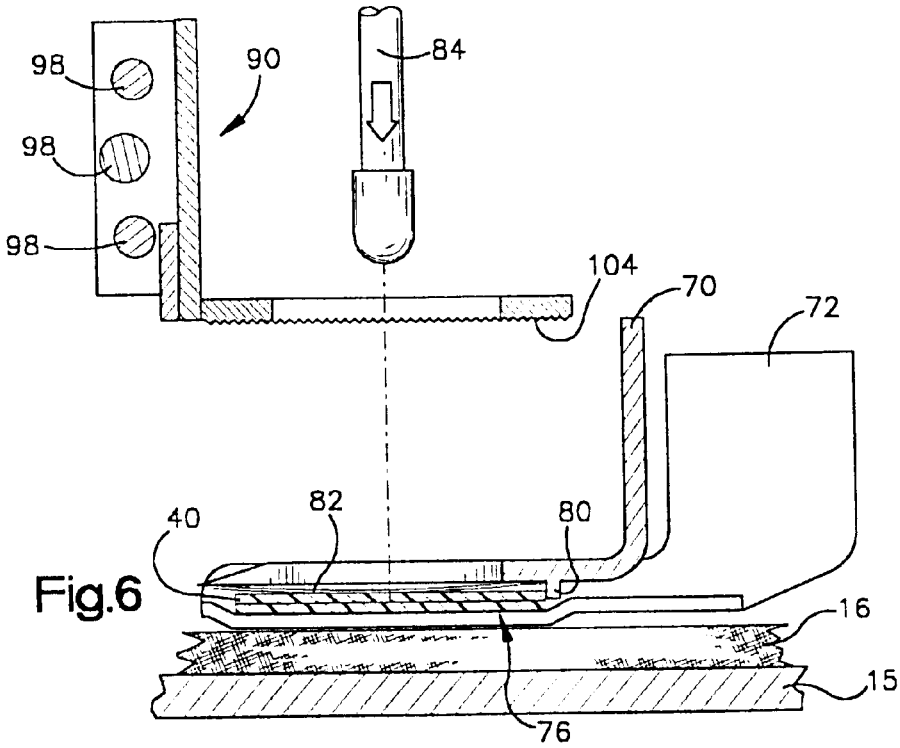
FIG. 6 is a cross-sectional view, taken in the direction of the arrows 6—6 in FIG. 5 of an end segment of the handle folding and double frame handle press of the apparatus of the invention.

After the ends 50, 52 are folded, the folded handle is transferred into position on the border material in the folded condition. As best shown in FIG. 6, the fork members 70 each include on an underside a structure configured to contact an edge of the handle material, for example in the form of a bar 80 that contacts an edge of the folded handle 40. The fork members 70 and the folding blades 72 are laterally displaced carrying the folded handle blank 40 off of the folding plate 62 into position on the border material 16, as shown in FIG. 5. The border material 16 is supported by a sewing platform 15. As shown in FIG. 6, each "tine" of each fork member 70 includes a spring clip 82, such as a leaf-type spring, which applies a biasing force to the folded ends 50, 52 of the handle blank 40, to maintain pressure on the folded ends during the transfer operation as the handle is slid off of the folding plate 62 to the side. The top plate 64 includes a side door 68 that opens to allow the handle blank 40 to be removed from the folding plate 62 to the side. A piston actuator 67 (as shown) or any other equivalent structure can be used to actuate the side door 68. An opposing side wall 69 can also be provided to extend from the folding plate 62 to the top plate 64.

Figure 7:
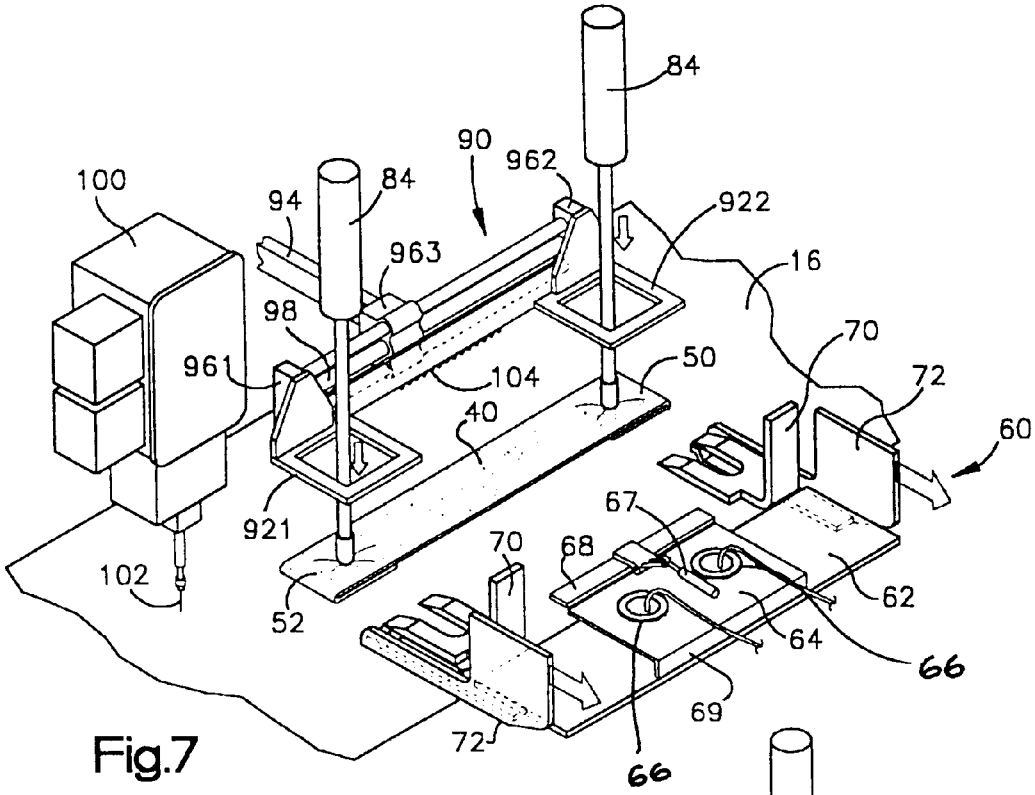
Figure 8:
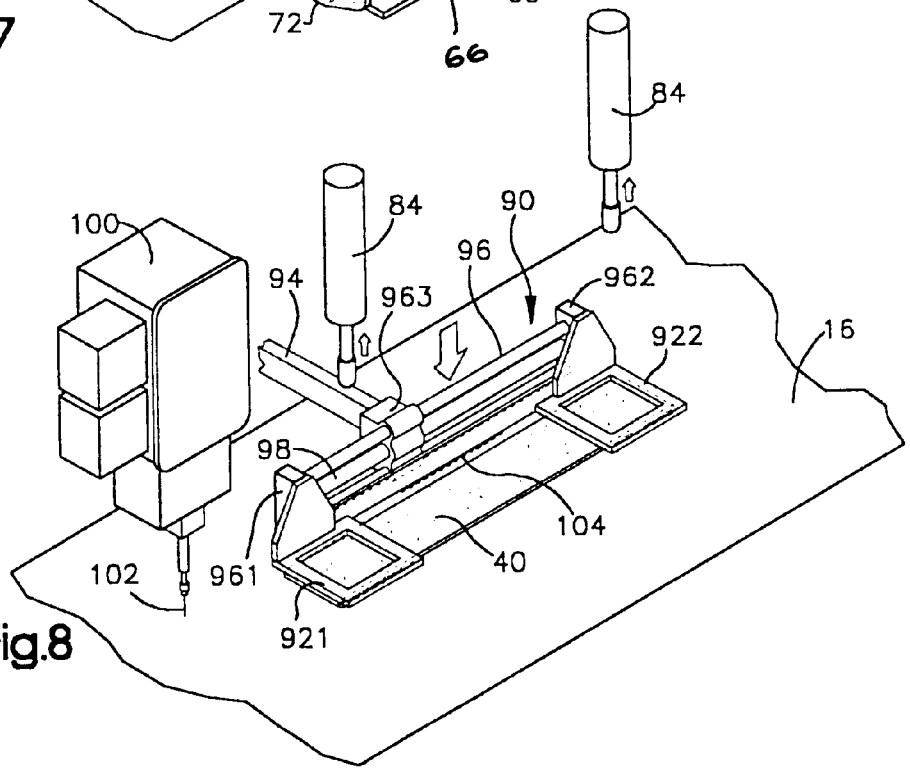

As shown in FIGS. 6 and 7, when the handle blank 40 is thus positioned over the border material, a pair of vertical cylinder rods 84 are actuated to extend down on the folded ends 50, 52. The fork members 70 include an opening between the "tines" to admit the cylinder rods 84. When the cylinder rods 84 are in place, the fork members 70 and the folding blades 72 retract, leaving the handle blank 40 in its proper position on the border material, as shown in FIG. 7. As shown in FIGS. 7 and 8, the cylinder rods 84 are vertically displaced between retracted and holding positions. The cylinders 84 are preferably pneumatically actuated, and can self-compensate for different thicknesses of handle material.

As shown in FIGS. 7 and 8, after the fork members 70 and folding blades 72 retract, a double frame handle press 90 vertically descends to press the folded ends 50, 52 of the handle blank 40 on to the border material 16. The double frame handle press 90 preferably includes a pair of generally square frames 921, 922 for pressing down upon the perimeter regions of the respective folded ends 50, 52. The vertical motion of the double frame handle press can be accomplished by connection to the clamp mechanism incorporated into the Mitsubishi PLK-B1006 series commercial sewing machine, which is an example of one type of sewing machine with which the invention can be practiced. As shown in FIG. 7, the cylinder rods 84 pass through the openings in the respective frames 921, 922 of the double frame handle press 90. When the double frame handle press 90 is securely in place, the cylinder rods 84 retract, as shown in FIG. 8, thus leaving the folded handle ends freely exposed within the frames 921,922 for application of a stitch pattern by a sewing needle.

The double frame handle press 90 is connected to an X-Y carriage assembly (not shown) via strut 94. The X-Y carriage assembly is incorporated into the sewing machine, such as the Mitsubishi PL-B1006, and is operative to move any assembly connected to it (via strut 94) in a program-controlled pattern under a sewing needle 102 which extends from a sewing head 100. For example, one type of programmed stitch pattern may be a box stitch placed within the each frame 921, 922 through the handle and underlying border material.

The double frame handle press 90 is mounted to a rodless magnetically coupled translation device, indicated generally at 96, such as a Bimba Ultran rodless cylinder assembly. The device 96 includes first and second blocks 961 and 962 attached respectively to frames 921 and 922, and a central block 963 fixed relative to strut 94. The blocks 961 and 962 are connected by three rods, one of which is pneumatically charged, and magnetically coupled. When pneumatically actuated, block 962 is forced toward and into contact with block 963, thus translating the double frame handle press to position frame 922 where frame 921 was previously located. By this arrangement, only the double frame handle press 90 is moved to position frame 922 under the sewing needle, thus avoiding the need to increase the amount of travel of the X-Y carriage assembly of the sewing machine, and eliminating the need for the entire X-Y carriage assembly to repeatedly traverse the range between the two frames.

The double frame handle press 90 is further equipped with a material engagement surface, such as material engagement teeth 104, as shown in FIG. 8, which may be located on either one of the frames or on a connecting member 93 which extends between the frames. The engagement teeth 104 function to grip the border material to move it in unison with the handle material through the X-Y sew pattern and along with the motion of the translation device 96. Alternatively, the material engagement surface of the double frame handle press 90 may contact the handle material, or both the handle material and border material.

Figure 10:
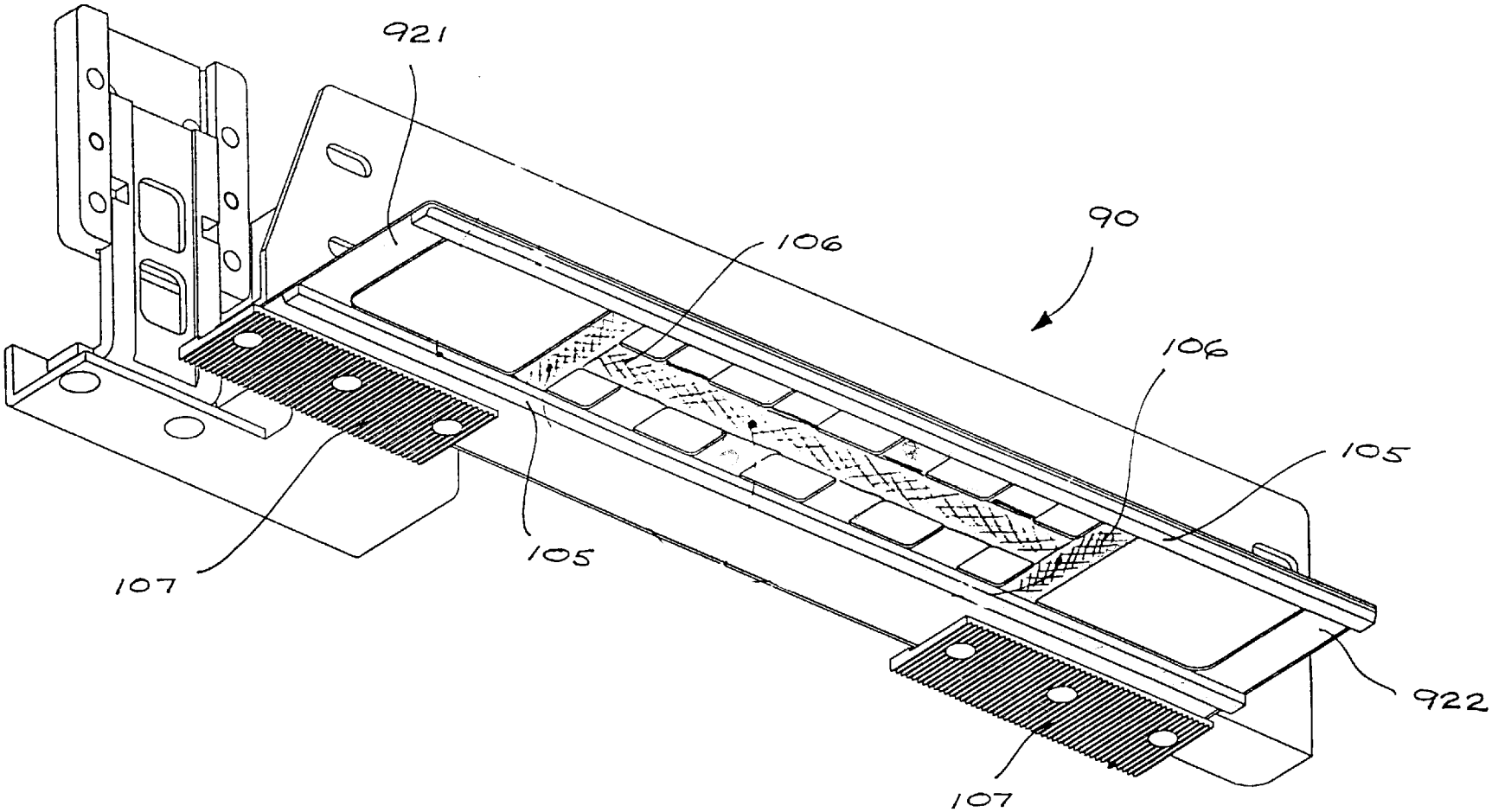
FIG. 10 is an isolated view of a preferred embodiment of the double frame handle press component of the apparatus of the invention.

FIG. 10 illustrates a preferred embodiment of the double frame handle press 90 which includes laterally opposed side rails 105 which run substantially the length of the press to define a channel in which the handle 40 is positioned and squarely registered. High friction tape 106 or other frictional surface coating is applied to the underside surface of the press structure between the frames 921 and 922 to frictionally engage the handle. Border clamping pads 107 are provided proximate to frames 921, 922 to frictionally engage the border material for the described lateral transfer. Also, the end sections 921*e* and 922*e* can be eliminated from the double frame handle press to avoid any potential interference with the folded ends of the handle when the handle press is retracted upward as described. The border clamping pads 107 can be mounted in an articulated manner, such as with one or more spring members, to achieve positive engagement with the border material, which due to quilting does not have a smooth or even surface.

After the handle 40 has been securely attached to the border material 16, the finished border piece is advanced by drive rollers 110. Afterwards, the border is cut to length with a guillotine-type cutter 112, in which an excess splice section is automatically accounted for by the control system.

Each of the various described functions of the machine, as performed by pneumatic, hydraulic or electric actuation mechanisms, are controllable by a digital process controller. The controlled parameters include operation of the border material pre-feeder and associated encoder for length measurement and splice detection; secondary encoded length measurement for handle placement; handle material feed drive and cutting and operation of the handle feeder; operation of the handle folding assembly, and operation of the primary border drive rollers and cutter. A separate interfaced controller may be used for operation of the X-Y carriage assembly of the sewing machine to which the double frame handle press is attached, and for operation of the sewing machine.

Other control functions which can be implemented in accordance with the invention include menus for inputting border style designations based upon the type of border material to be used. Known stretch factors of selected materials are stored in the control system and compensated for in the material advancement and handle placement signals to the process drive components. Also, in the operation of the border material pre-feeder, detection of a length of border material insufficient to produce a complete continuous border will prompt the machine to produce two border halves. The controller can be operated by a touch screen which displays a menu of input options pertaining to the number and size of borders to be produced, style designation, number and placement of handles, and stitch pattern. These and other control features can be incorporated to provide a system which produces a wide variety of borders with minimal set-up change to the machinery.

Although described with reference to the automated production of mattress borders, the various principles and concepts of the invention are of course applicable to other types of automated sewing and material handling operations. It is also understood that various changes in the details, materials and arrangements of parts which have been herein described and illustrated may be made by those skilled in the art are within the scope of the invention, as defined by the accompanying claims and equivalents thereof.

What is claimed as the invention is:

1. A machine for automatically producing a mattress border with at least one handle sewn to the mattress border material, the machine comprising:

a spool of border material;

a border material feed mechanism for feeding border material from the spool of border material;

a spool of handle material;

a handle material feed mechanism operative to feed and cut handle material from the spool of handle material;

a handle cutter for cutting a handle from the handle material;

a sewing platform over which the border material passes;

a handle folder assembly for folding ends of a handle under prior to placement of a folded handle on the border material at a position where the folded handle is to be sewn to the border material, the handle folder assembly having:

a folding plate having first and second ends;

a folding blade at each end of the folding plate, each folding blade operative to descend down upon an end of a handle which extends beyond an end of the folding plate, and further operative to move underneath an end of the folding plate to fold the end of the handle under the folding plate;

a clamp fork positioned over each end of the folding blade and operative to be lowered upon a folded end of the handle, and operative to move the handle off of the folding blade and on to the border material;

a double frame handle press operative to frame and compress each folded end of the handle material positioned on the border material, and to move each folded end of the handle upon the sewing platform and under a sewing needle in a sewing pattern which attaches the folded ends of the handle to the border material.

2. The machine of claim 1 wherein the spool of border material is mounted upon a spool rack configurable to hold one or more spools of border material.

3. The machine of claim 1 wherein the border material feed mechanism comprises a pair of drive rollers operative to advance border material from the spool, and a sensor in operative association with the border material to measure a length of border material advanced from the spool sufficient to produce a mattress border.

4. The machine of claim 1 further comprising a rack configured to support one or more spools of handle material in generally parallel spool channels, each spool channel having support rollers on which the spools roll as handle material is pulled from the spools, the rack being mounted upon rails generally transverse to the spool channels, whereby a selected spool of handle material within the rack is selectable for production and attachment of handles by movement of the rack upon the rails.

5. The machine of claim 1 wherein the handle material feed mechanism comprises a pair of drive rollers operative to draw handle material from the spool, and a sensor to measure an amount of handle material drawn from the spool, and a cutter to cut an amount of handle material from the spool sufficient to form a mattress handle.

6. The machine of claim 5 wherein the handle material feed mechanism further comprises a retractable handle guide which guides a piece of handle material cut from the spool into the handle folder assembly.

7. The machine of claim 1 wherein the handle folder assembly is arranged to receive a piece of handle material cut from the spool of handle material and positioned on the folding plate, the handle folder assembly further having side and top walls which enclose a portion of the handle material, and first and second open ends, the handle material being inserted into the handle folder assembly through the first open end, and through which ends of the handle material extend beyond the ends of the folding plate.

8. The machine of claim 7 wherein the handle folder assembly further comprises one or more diaphragms in a top wall, the diaphragm operative to extend into an interior space in the handle folder assembly to contact the handle material positioned upon the folding plate.

9. The machine of claim 7 wherein one of the side walls of the handle folder assembly is operative to open to allow the handle material to be removed laterally from the handle folder assembly and off of the folding plate.

10. The machine of claim 1 wherein each folding blade has a top recessed surface configured to register the folded ends of the handle material underneath the folding plate.

11. The machine of claim 1 wherein each folding blade has a generally horizontal section oriented generally parallel to the folding plate, and a generally vertical section connected to the horizontal section.

12. The machine of claim 1 wherein each clamp fork has one or more tines, and a spring underneath a tine which contacts the handle when the clamp fork is lowered upon the handle.

13. The machine of claim 1 wherein each clamp fork has a pusher bar configured to contact an edge of the handle when the clamp fork is lowered upon the handle.

14. The machine of claim 1 wherein each fork clamp has two tines with a gap between the tines dimensioned to receive an axial end of a handle fold retainer rod.

15. The machine of claim 1 wherein the double frame handle press has two spaced apart frames, each frame dimensioned to generally frame a folded end of the handle material when the double frame handle press is compressed upon the folded handle material positioned on the border material, the double frame handle press being mounted upon a shuttling device operative to shuttle the double frame handle press from one of the two frames being positioned under a sewing needle to the other of the two frames being positioned under the sewing needle.

16. The machine of claim 1 wherein the double frame handle press further comprises a material gripping structure which engages the border or handle material when the double frame handle press is compressed upon the handle material.

17. The machine of claim 1 wherein the shuttling device to which the double frame handle press is mounted is a rodless magnetically coupled cylinder assembly having a stationary block attached to one end of the double frame handle press and a movable block attached to another end of the double frame handle press, rodless magnetically coupled cylinders extending between the two blocks, operative to move the movable block toward and away from the stationary block to thereby shift the double frame handle press from one position to another position.

18. The machine of claim 1 further comprising at least one handle material fold retention rod which extends downward on to the folded handle material positioned on the border material to hold the handle material in a folded condition.

19. The machine of claim 18 comprising a handle material fold retention rod mounted to extend through each frame of the double frame handle press.

20. The machine of claim 18 wherein the handle material fold retention rods are actuated to extend downward to contact a folded end of the handle material prior to compression of the handle material by the double frame handle press, and actuated to retract from the handle material when the double frame handle press is compressed upon the handle material.

21. A machine for automatically sewing ends of a fabric handle to a mattress border, the machine comprising:

a supply of border material;

a supply of handle material;

a handle folding assembly;

a double frame handle press;

a sewing platform, and a sewing head;

drive rollers for drawing border material from the border material supply onto the sewing platform;

drive rollers for drawing handle material from the handle material supply into the handle folding assembly;

a handle material cutter for cutting a length of handle material from the handle material supply;

the handle folding assembly having:

a folding plate with first and second ends about which ends of a piece of handle material are folded;

folding blades which are actuated to descend down upon the ends of the handle material and under the folding blade;

folded handle transfer arms which transfer the handle material with the ends folded from the folding blade on to the border material on the sewing platform; and a double frame handle press which compresses down upon the handle on the border material.

22. The machine of claim 21 wherein the supply of border material is on a reel, and the reel is supported by a rack, and the rack is adaptable to support multiple reels.

23. The machine of claim 21 wherein the supply of handle material is on a reel, and the reel is supported within a movable magazine, and the magazine is configured to hold multiple reels.

24. The machine of claim 21 wherein the handle folding assembly is movably mounted relative to the sewing platform, and in an operable position is generally opposed to the sewing head.

25. The machine of claim 22 wherein the drive rollers for drawing border material from the border material supply are mounted upon the rack which supports the border material.

26. The machine of claim 21 wherein the drive rollers for drawing handle material from the handle material supply are mounted proximate to the handle material cutter, and proximate to a handle material feeder which extends toward the handle folding assembly as handle material is fed to the handle folding assembly.

27. The machine of claim 21 wherein the double frame handle press includes two generally flat frames, each frame having a flat undersurface which contacts the folded ends of the handle material, each frame being connected to a shuttling device operative to move each frame in a position generally under the sewing head.

28. The machine of claim 27 further comprising a border material gripper connected to the shuttling device and operative to grip the border material to cause movement of the border material in accordance with movement of the shuttling device.

29. The machine of claim 27 wherein the shuttling device is a pneumatically operated magnetically coupled rod and block assembly having two blocks and rods extending between the two blocks, and a frame connected to each block.

30. The machine of claim 29 wherein one of the blocks of the rod and block assembly is fixedly mounted proximate to the sewing head.

31. A material folding device operative to fold a portion of a piece of material under a plate and to transfer material in a folded condition, the device comprising:

a folding plate having a planar surface for supporting at least a portion of material to be folded, and ends beyond which a piece of material may extend;

at least one material holding device above the folding plate, the material holding device being controllable to extend downward into contact with a piece of material on the folding plate, at least one folding blade operative to extend downward past an end of the folding plate and to extend under an end of the folding plate, a top plate in which at least one material holding device is mounted, and at least one side wall between the top plate and the folding plate, and wherein the side wall is moveable.

32. A material folding device operative to fold a portion of a piece of material under a plate and to transfer material in a folded condition, the device comprising:

a folding plate having a planar surface for supporting at least a portion of material to be folded, and ends beyond which a piece of material may extend;

at least one material holding device above the folding plate, the material holding device being controllable to extend downward into contact with a piece of material on the folding plate, and at least one folding blade operative to extend downward past an end of the folding plate and to extend under an end of the folding plate, at least one fold compression device operative to extend down on top of a piece of material on the folding plate and over a portion of the piece of material under the folding plate, wherein the fold compression device is operative to move a piece of folded material to a side of the folding plate.

33. A material folding device operative to fold a portion of a piece of material under a plate and to transfer material in a folded condition, the device comprising:

a folding plate having a planar surface for supporting at least a portion of material to be folded, and ends beyond which a piece of material may extend;

at least one material holding device above the folding plate, the material holding device being controllable to extend downward into contact with a piece of material on the folding plate, at least one folding blade operative to extend downward past an end of the folding plate and to extend under an end of the folding plate, wherein the material holding device is an inflatable diaphragm positioned over the folding plate.

34. A material folding device operative to fold a portion of a piece of material under a plate and to transfer material in a folded condition, the device comprising:

a folding plate having a planar surface for supporting at least a portion of material to be folded, and ends beyond which a piece of material may extend;

at least one material holding device above the folding plate, the material holding device being controllable to extend downward into contact with a piece of material on the folding plate, at least one folding blade operative to extend downward past an end of the folding plate and to extend under an end of the folding plate, at least one fold compression device operative to extend down on top of a piece of material on the folding plate and over a portion of the piece of material under the folding plate, wherein the fold compression device further comprises a spring member on an underside which contacts the material on the folding plate.

35. A device for folding a first piece of material, transferring the first piece of material in a folded state onto a second material, holding the first piece of material in a folded state in a fixed position on the second material, and moving both the first piece of material and second piece of material in unison in a pattern under a sewing needle, the device comprising:

a folding assembly operative to fold at least a portion of the first piece of material, the folding assembly having:

a folding plate having a planar surface for supporting the first material and at least one end beyond which a portion of the first material may extend, a folding blade operative to extend down past an end of the folding plate and to move under the folding plate to thereby fold an end of the first piece of material under the folding plate, a fold compression device operative to come in contact with a portion of the first piece of material over a portion of the first piece of material folded under the folding plate, the folding blade and fold compression device each operative to move to a side of the folding plate to transfer the first piece of material in a folded state onto a second piece of material, a press for holding the first piece of material in a folded state in a fixed position against the second piece of material, the press being connected to a carriage mechanism operative to move in a stitch pattern under a sewing needle of a sewing machine to attach the first piece of material to the second piece of material by sewing, and wherein a portion of the folding blade which contacts the first material is recessed, and wherein a folded portion of the first piece of material stays within the recessed portion when the folding blade moves to a side of the folding plate.

36. A device for folding a first piece of material, transferring the first piece of material in a folded state onto a second material, holding the first piece of material in a folded state in a fixed position on the second material, and moving both the first piece of material and second piece of material in unison in a pattern under a sewing needle, the device comprising:

a folding assembly operative to fold at least a portion of the first piece of material, the folding assembly having:

a folding plate having a planar surface for supporting the first material and at least one end beyond which a portion of the first material may extend, a folding blade operative to extend down past an end of the folding plate and to move under the folding plate to thereby fold an end of the first piece of material under the folding plate, a fold compression device operative to come in contact with a portion of the first piece of material over a portion of the first piece of material folded under the folding plate, the folding blade and fold compression device each operative to move to a side of the folding plate to transfer the first piece of material in a folded state onto a second piece of material, a press for holding the first piece of material in a folded state in a fixed position against the second piece of material, the press being connected to a carriage mechanism operative to move in a stitch pattern under a sewing needle of a sewing machine to attach the first piece of material to the second piece of material by sewing, wherein the fold compression device has a spring member which contacts the first piece of material.

* * * * *